US011041689B2

(12) United States Patent
McPherson et al.

(10) Patent No.: US 11,041,689 B2
(45) Date of Patent: Jun. 22, 2021

(54) SHOOTING DEVICE WITH STABILIZING FOREGRIP

(71) Applicant: MCP IP, LLC, Sparta, WI (US)

(72) Inventors: Mathew A. McPherson, Norwalk, WI (US); Mark J. Hayes, Sparta, WI (US)

(73) Assignee: MCP IP, LLC, Sparta, WI (US)

( * ) Notice: Subject to any disclaimer, the term of this patent is extended or adjusted under 35 U.S.C. 154(b) by 0 days.

(21) Appl. No.: 16/410,882

(22) Filed: May 13, 2019

(65) Prior Publication Data

US 2020/0025506 A1 Jan. 23, 2020

Related U.S. Application Data

(60) Provisional application No. 62/670,574, filed on May 11, 2018.

(51) Int. Cl.

| | |
|---|---|
| ***F41B 5/20*** | (2006.01) |
| ***F41B 5/12*** | (2006.01) |
| ***F41B 5/14*** | (2006.01) |

(52) U.S. Cl.

CPC ..... *F41B 5/123* (2013.01); *F41B 5/1426* (2013.01)

(58) Field of Classification Search

CPC .... F41B 5/12; F41B 5/123; F41B 5/14; F41B 5/1403; F41B 5/1426; F41C 23/16

USPC ..... 124/25, 86

See application file for complete search history.

(56) References Cited

U.S. PATENT DOCUMENTS

| | | | | |
|---|---|---|---|---|
| 13,572,508 | | 10/1920 | Payne | |
| 2,414,250 | A | 1/1947 | Williams | |
| 2,714,884 | A * | 8/1955 | Ickes | F41B 5/12 124/25 |
| 3,125,998 | A * | 3/1964 | Stevens | F41B 5/12 124/25 |
| 3,269,380 | A * | 8/1966 | Stevens | F41B 5/12 124/25 |
| 4,603,676 | A * | 8/1986 | Luoma | F41B 5/1469 124/25 |
| 5,749,348 | A * | 5/1998 | Oviedo-Reyes | F41B 5/12 124/25 |
| 6,705,304 | B1 * | 3/2004 | Pauluhn | F41B 5/12 124/25 |
| 7,340,857 | B1 * | 3/2008 | Bentley | F41A 25/10 42/1.06 |
| 7,559,167 | B1 | 7/2009 | Moody et al. | |
| 7,676,975 | B2 | 3/2010 | Phillips et al. | |
| 7,677,233 | B2 * | 3/2010 | Bednar | F41A 23/06 124/25 |
| 7,685,755 | B1 * | 3/2010 | Bentley | F41G 11/003 42/1.06 |
| 7,810,480 | B2 * | 10/2010 | Shepley | F41A 11/02 124/25 |
| 7,891,126 | B2 | 2/2011 | Moody et al. | |
| 7,938,108 | B2 * | 5/2011 | Popov | F41B 5/123 124/25 |
| 7,987,625 | B1 | 8/2011 | Moody et al. | |

(Continued)

*Primary Examiner* — Alexander R Niconovich

(74) *Attorney, Agent, or Firm* — Laabs Intellectual Property

(57) ABSTRACT

In some embodiments, a crossbow comprises a stock, a bow portion, a latch, a trigger and a foregrip. In some embodiments, the foregrip is supported by the stock and arranged to move with respect to the stock between a first position and a second position.

19 Claims, 8 Drawing Sheets

(56) References Cited

U.S. PATENT DOCUMENTS 7,997,258 B2 * 8/2011 Shepley ..... F41B 5/1469 124/25
8,033,275 B2 * 10/2011 Bednar ..... F41B 5/123 124/25
8,215,047 B2 7/2012 Ash, Jr. et al.
8,220,445 B2 * 7/2012 Bednar ..... F41C 23/16 124/25
8,341,865 B2 1/2013 Moody et al.
8,393,104 B1 3/2013 Moody et al.
8,607,492 B2 12/2013 Hartley et al.
8,701,641 B2 * 4/2014 Biafore, Jr. ..... F41B 5/123 124/25
8,813,735 B2 * 8/2014 Biafore, Jr. ..... F41B 5/12 124/25
8,839,544 B2 9/2014 Troy et al.
8,984,789 B2 3/2015 Adcock, Jr.
9,062,933 B1 6/2015 Allen et al.
9,228,796 B2 1/2016 Adcock, Jr. et al.
9,234,722 B2 1/2016 Rice et al.
9,423,208 B1 8/2016 Mahmalji
9,523,551 B2 12/2016 Iannello
9,784,529 B1 10/2017 Angle
9,891,020 B2 * 2/2018 Jen ..... F41C 23/16
10,161,709 B1 * 12/2018 Wright ..... F41A 19/183
10,197,358 B2 2/2019 Hebden et al.
10,527,383 B2 * 1/2020 Fulton ..... F41C 23/16
2010/0012108 A1 * 1/2010 Bednar ..... F41B 5/123 124/25
2013/0213371 A1 * 8/2013 Biafore, Jr. ..... F41B 5/1403 124/25
2013/0213372 A1 * 8/2013 Biafore, Jr. ..... F41B 5/123 124/25
2015/0219420 A1 * 8/2015 Bednar ..... F41B 5/1426 124/25
2016/0054090 A1 * 2/2016 Nettleton ..... F41B 5/1453 124/86
2016/0195361 A1 * 7/2016 Barnett ..... F41B 5/12 42/90
2019/0025004 A1 * 1/2019 Thalberg ..... F41B 5/1469
2019/0025008 A1 * 1/2019 Barnett ..... F41B 5/1426
2019/0212091 A1 * 7/2019 Fulton ..... F41B 5/1403
2019/0316874 A1 * 10/2019 McPherson ..... F41C 23/16

* cited by examiner

SHOOTING DEVICE WITH STABILIZING FOREGRIP

CROSS-REFERENCE TO RELATED APPLICATIONS

This application claims the benefit of U.S. Patent Application No. 62/670,574, filed May 11, 2018, the entire content of which is hereby incorporated herein by reference.

BACKGROUND OF THE INVENTION

This invention relates generally to shooting devices, such as devices that can launch a projectile.

Multiple types of shooting devices are generally known in the art. A firearm can be used to launch a bullet, for example via expanding gasses provided by a chemical propellant. Bows can be used to launch arrows, for example by drawing a bowstring to store energy in the bow, then releasing the bowstring to launch an arrow.

Shooting devices are typically aimed by a user prior to the launching of the projectile, with the intention of the projectile traveling to a desired aiming point.

Instability during aiming can contribute to inaccuracy.

There remains a need for shooting devices and accessories having novel designs that can contribute to increased accuracy.

All US patents and applications and all other published documents mentioned anywhere in this application are incorporated herein by reference in their entirety.

Without limiting the scope of the invention a brief summary of some of the claimed embodiments of the invention is set forth below. Additional details of the summarized embodiments of the invention and/or additional embodiments of the invention may be found in the Detailed Description of the Invention below.

A brief abstract of the technical disclosure in the specification is provided as well only for the purposes of complying with 37 C.F.R. 1.72. The abstract is not intended to be used for interpreting the scope of the claims.

BRIEF SUMMARY OF THE INVENTION

In some embodiments, a crossbow comprises a stock, a bow portion, a latch, a trigger and a foregrip. In some embodiments, the foregrip is supported by the stock and arranged to move with respect to the stock between a first position and a second position. In some embodiments, the foregrip comprises finger guards.

In some embodiments, the foregrip is biased to the first position.

In some embodiments, the crossbow comprises a carriage, the carriage moves with respect to the stock and the foregrip is attached to the carriage.

In some embodiments, the stock comprises a slot and a portion of the carriage is oriented in the slot.

In some embodiments, the foregrip is located closer to the trigger in the first position than in the second position.

In some embodiments, the foregrip moves along a linear path between the first position and the second position. In some embodiments, the linear path oriented parallel to a shooting axis of the crossbow.

These and other embodiments which characterize the invention are pointed out with particularity in the claims annexed hereto and forming a part hereof. However, for a better understanding of the invention, its advantages and objectives obtained by its use, reference can be made to the drawings which form a further part hereof and the accompanying descriptive matter, in which there are illustrated and described various embodiments of the invention.

BRIEF DESCRIPTION OF THE DRAWINGS

A detailed description of the invention is hereafter described with specific reference being made to the drawings.

DETAILED DESCRIPTION OF THE INVENTION

Figure 1:
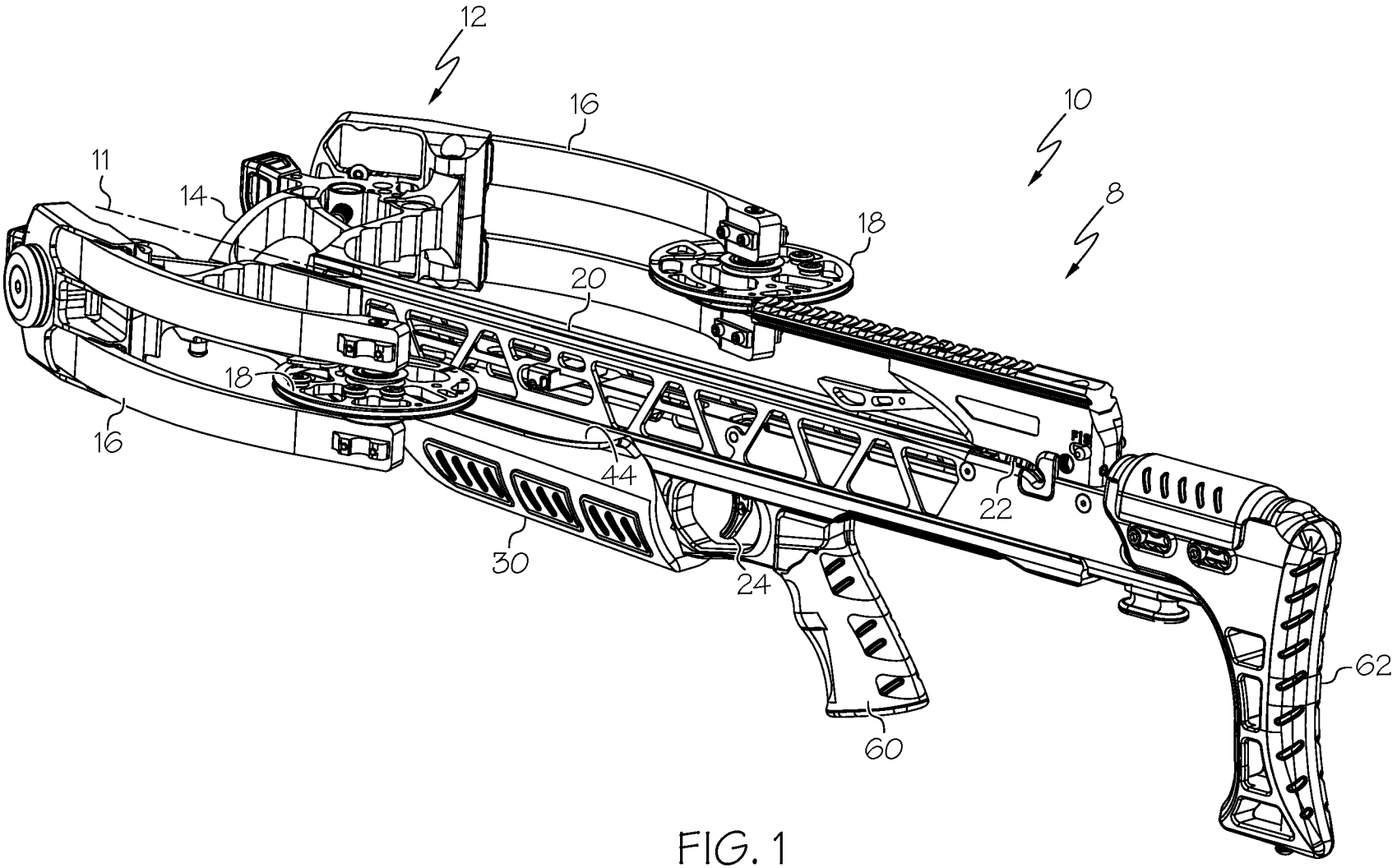
FIG. 1 shows an embodiment of a crossbow.

While this invention may be embodied in many different forms, there are described in detail herein specific embodiments of the invention. This description is an exemplification of the principles of the invention and is not intended to limit the invention to the particular embodiments illustrated.

For the purposes of this disclosure, like reference numerals in the figures shall refer to like features unless otherwise indicated.

FIG. 1 shows an embodiment of a shooting device 10. In some embodiments, a shooting device 10 comprises a crossbow 8. In some embodiments, a crossbow 8 comprises a bow portion 12 comprising a prod 14, limbs 16 and a bowstring. In some embodiments, the bow portion 12 comprises a compound bow, for example comprising rotatable members 18. In some embodiments, the crossbow 8 comprises a rail 20, a string latch 22 and a trigger 24. In some embodiments, the rail 20 defines a shooting axis 11. The rail 20 can also be called a stock.

In some embodiments, a crossbow 8 comprises features as disclosed in U.S. Pat. No. 9,671,189, the entire disclosure of which is hereby incorporated herein by reference. In some embodiments, a crossbow 8 comprises features as disclosed in US 2018/0224237, the entire disclosure of which is hereby incorporated herein by reference.

In some embodiments, a crossbow 8 comprises a foregrip 30. In some embodiments, the foregrip 30 is attached to the rail 20. In some embodiments, the foregrip 30 comprises finger guards 44. In some embodiments, the foregrip 30, or a portion of the foregrip 30, is moveable with respect to other portions of the crossbow 8, such as the rail 20. In some embodiments, the crossbow 8 comprises a rear grip 60. In some embodiments, the crossbow 8 comprises a buttstock 62. In some embodiments, the foregrip 30 is moveable with respect to the rear grip 60. In some embodiments, the trigger 24 is located between the foregrip 30 and the rear grip 60.

Figure 2:
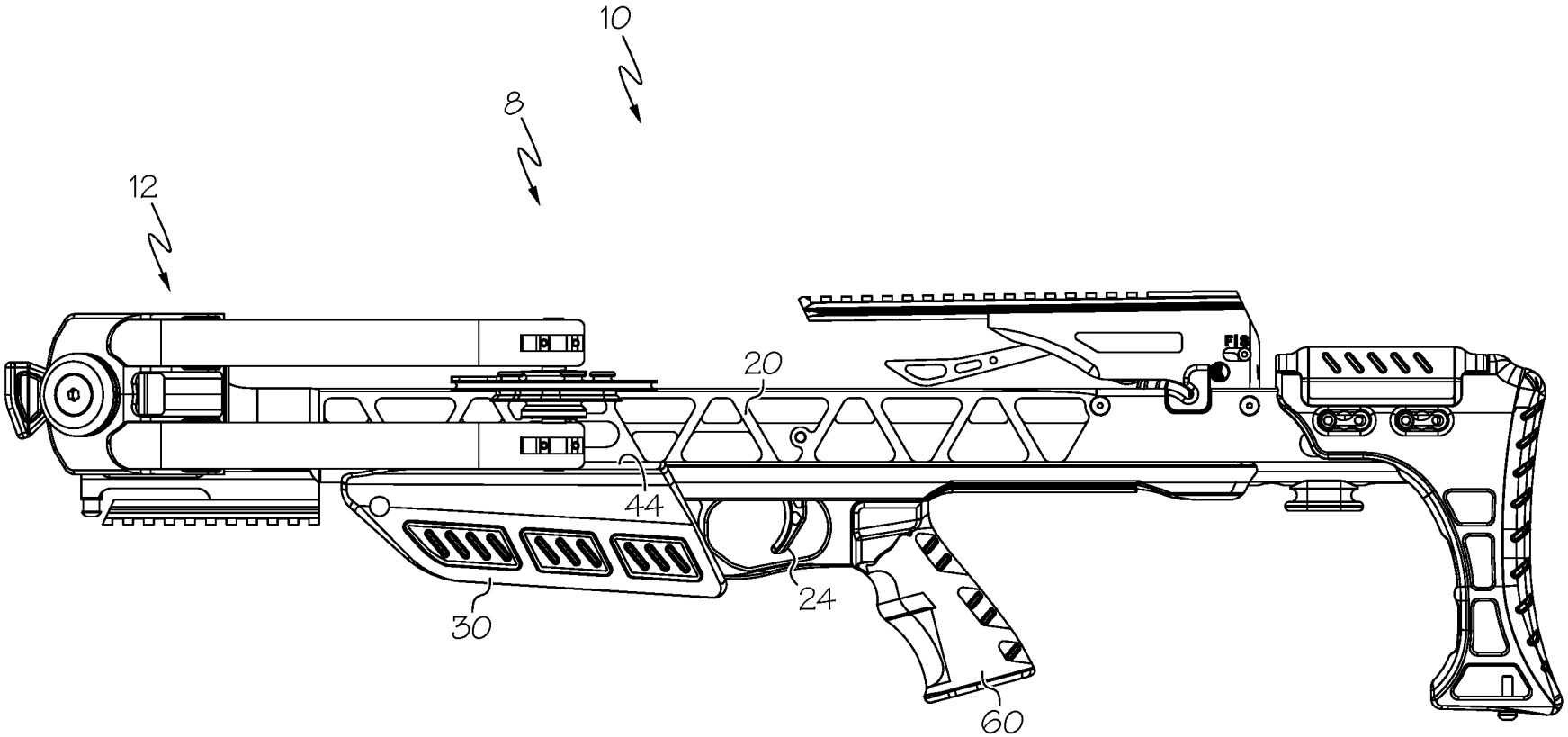
FIG. 2 shows a side view of the crossbow shown in FIG. 1.

FIG. 2 shows another view of the crossbow 8 of FIG. 1. The foregrip 30 is in a first position with respect to the rail 20 and other portions of the crossbow 8, such as the rear grip 60. In some embodiments, the foregrip 30 is moveable from the first position, for example to a second position with respect to the rail 20.

Figure 3:
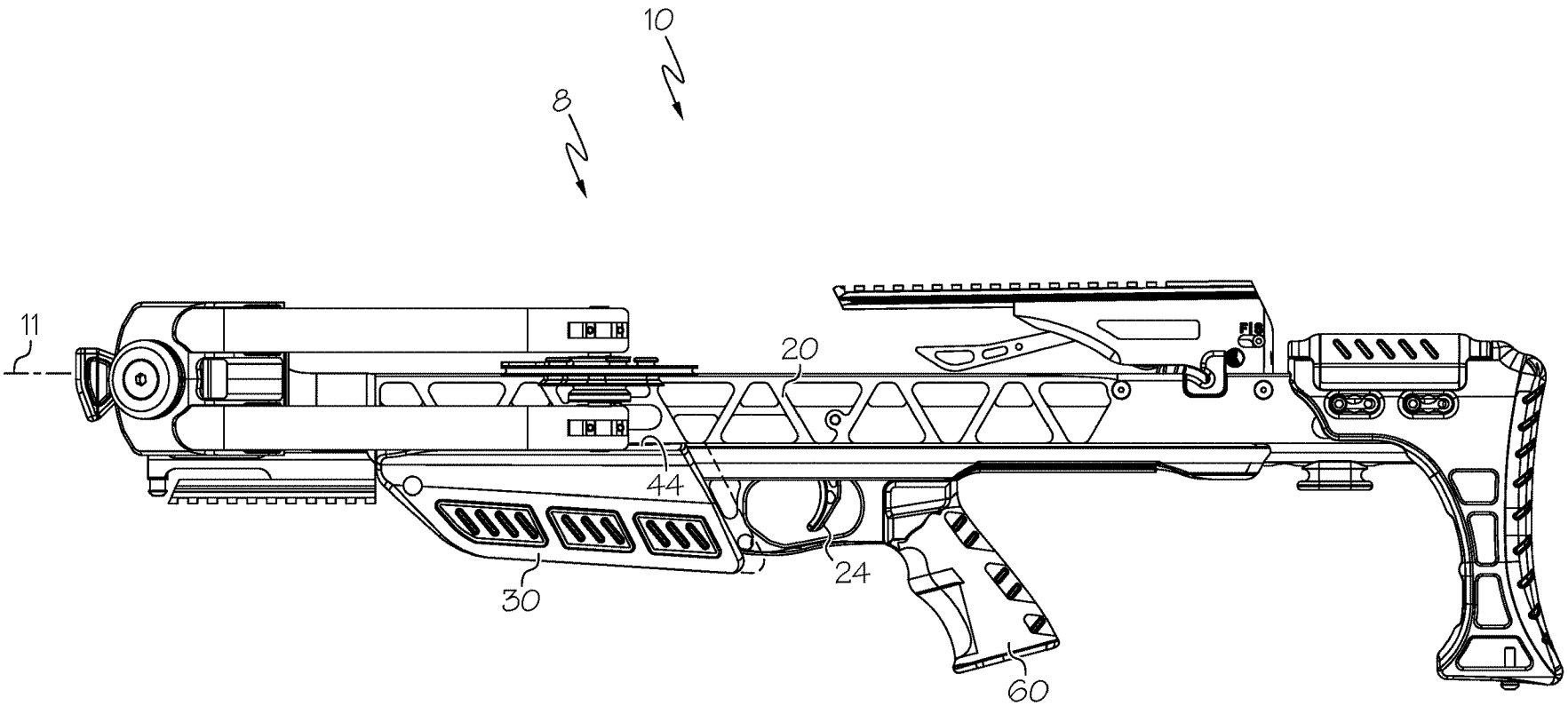
FIG. 3 shows movement of an embodiment of a foregrip.

FIG. 3 shows the crossbow 8 of FIG. 2 with the foregrip 30 in a second position. The first position of the foregrip 30 is shown in broken lines. In some embodiments, the foregrip 30 travels along a linear path. In some embodiments, the foregrip 30 travels substantially parallel to a longitudinal axis of the rail 20. In some embodiments, the foregrip 30 travels substantially parallel to the shooting axis 11. In some embodiments, the first position is located closer to the trigger 24 than the second position.

In some embodiments, the foregrip 30 is biased to the first position. In some embodiments, the foregrip 30 can be displaced from the first position by an external application of force. In some embodiments, the foregrip 30 will return to its first position when the external force is removed.

Figure 4:
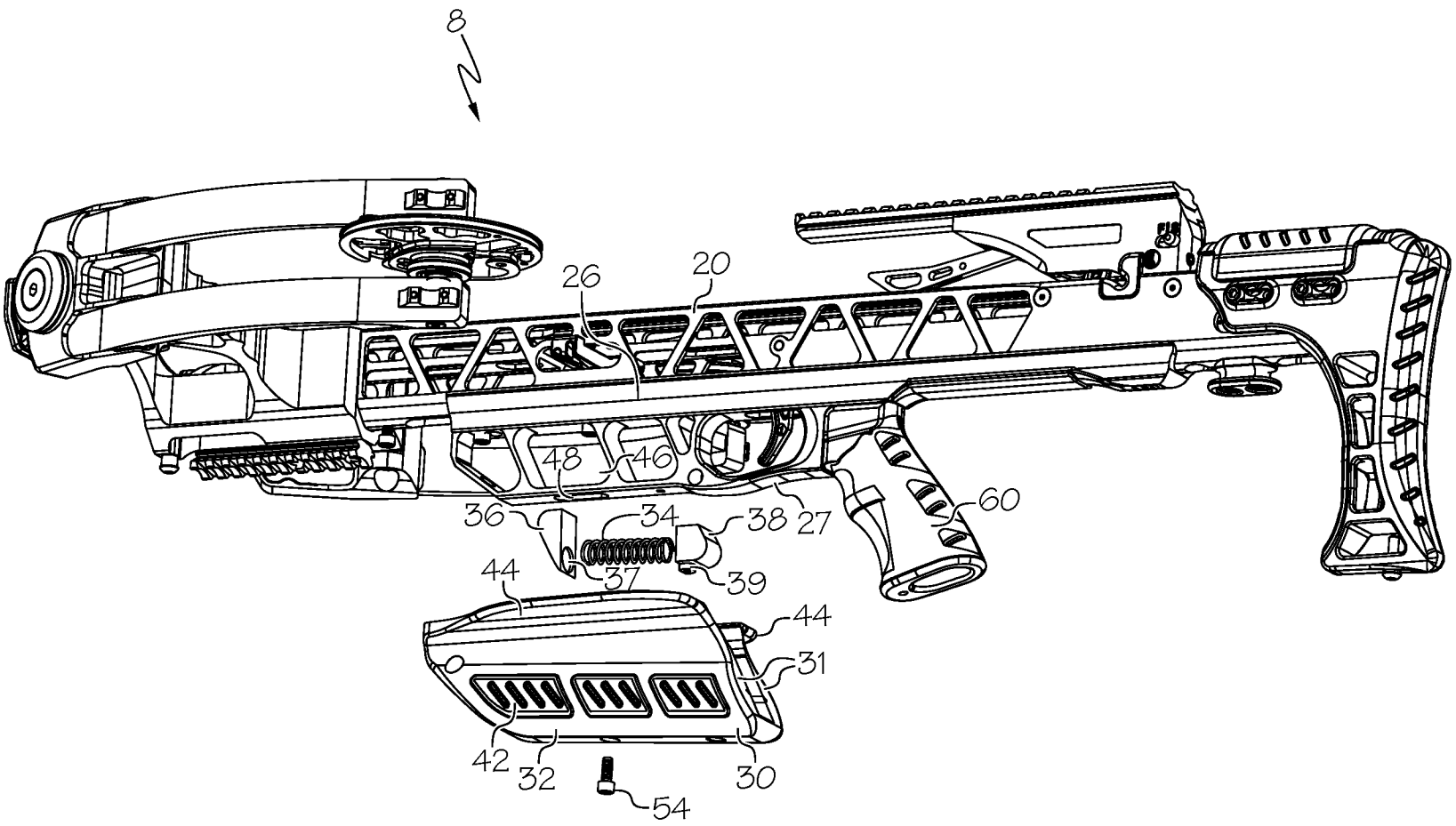
FIGS. 4 and 5 show exploded views of the crossbow of FIG. 1.
Figure 5:
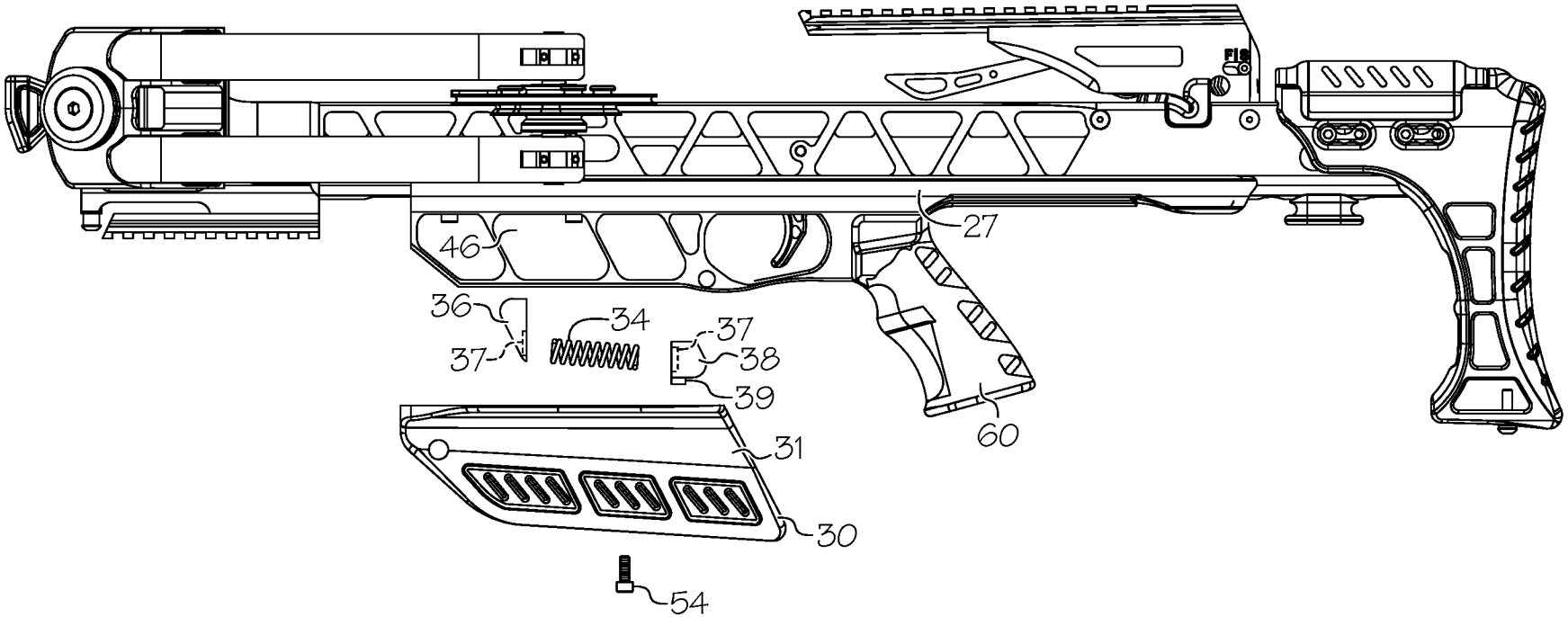
Figure 6:
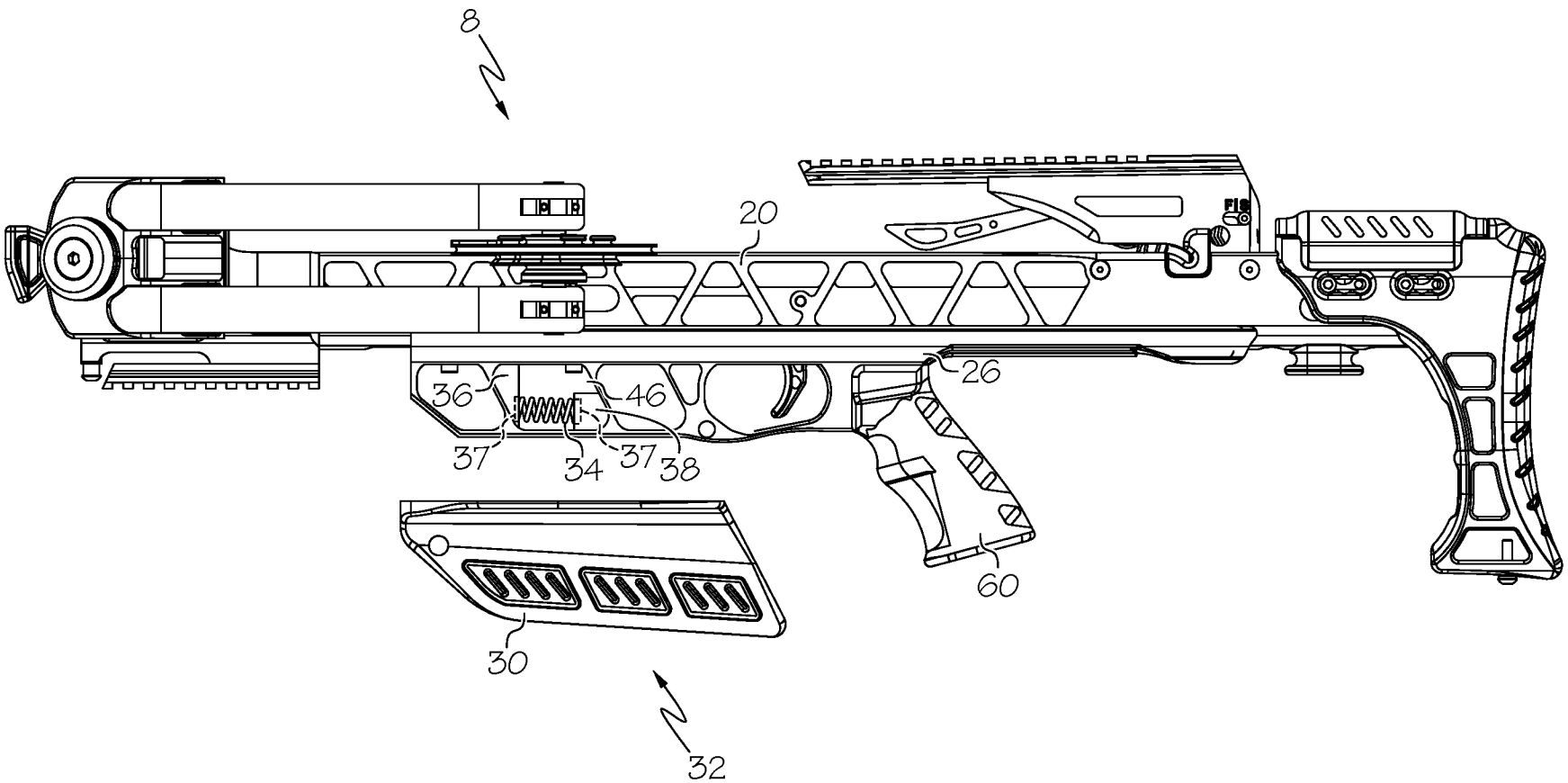
FIGS. 6 and 7 show an embodiment of a crossbow with the foregrip removed.
Figure 7:
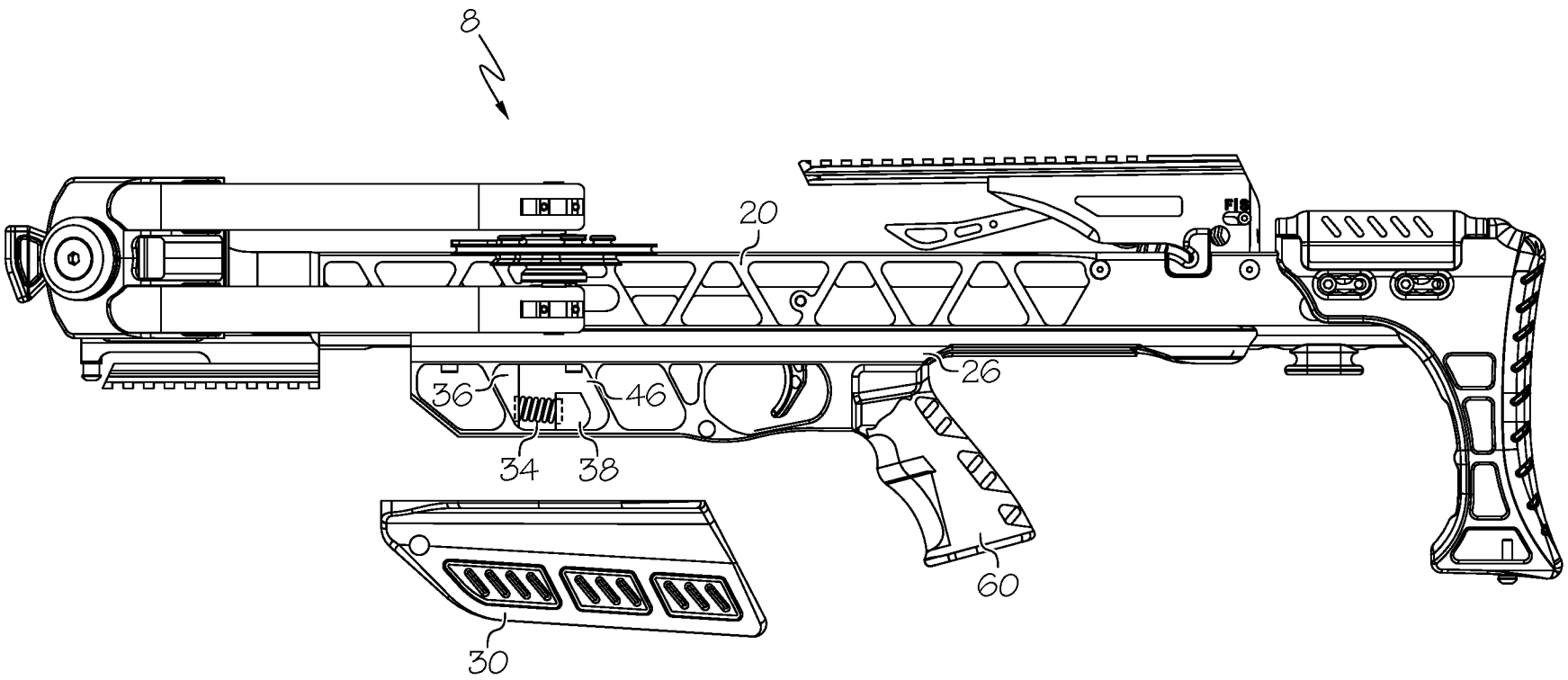

FIGS. 4 and 5 show exploded views of an embodiment of a crossbow 8. FIGS. 6 and 7 show the same components in a partially assembled configuration. In some embodiments, a crossbow 8 comprises a lower stock 26. In some embodiments, a lower stock 26 comprises a portion of the rail 20, which can also be considered the stock. In some embodiments, the foregrip 30 is slidably engaged with the lower stock 26.

In some embodiments, the lower stock 26 comprises a body 27 and a carriage 38 that is moveable with respect to the body 27. In some embodiments, the body 27 comprises a cavity 28, and the carriage 38 is at least partially positioned in the cavity 28. In some embodiments, the body 27 comprises a slot 48. In some embodiments, the slot 48 comprises a guide for the carriage 38. In some embodiments, at least a portion of the carriage 38 is positioned in the slot 48 and moves along a length of the slot 48. In some embodiments, the carriage 38 comprises a protrusion 39 that is positioned in the slot 48.

In some embodiments, the foregrip 30 is attached to the carriage 38, for example by a fastener 54. In some embodiments, the fastener 54 extends through the slot 48.

In some embodiments, the foregrip 30 comprises opposed sidewalls 31 that straddle the lower stock 26. Desirably, the foregrip 30 comprises a contacting surface 32 arranged to contact a shooter's forehand. In some embodiments, the foregrip 30 comprises one or more grip surfaces 42 arranged to increase engagement between the foregrip 30 and a user. In some embodiments, grip surfaces 42 comprise surface texturing, peaks, valleys, etc. In some embodiments, grip surfaces 42 comprise a material that is different from a material used for other portions of the foregrip 30, such as a rubber or elastomeric material, or a material having a higher friction coefficient. In some embodiments, the foregrip 30 comprises finger guards 44 that extend laterally and help to prevent a shoot's fingers from becoming oriented above the finger guards 44.

In some embodiments, the lower stock 26 comprises a cavity 46. In some embodiments, the slot 48 comprises an opening into the cavity 46. In some embodiments, the carriage 38 is positioned in the cavity 46. In some embodiments, a biasing member 34 is positioned in the cavity 46.

FIG. 6 shows embodiments of the carriage 38 and biasing member 34 oriented in the cavity 46. The carriage 38 is shown in a first position with respect to the rail 20. In some embodiments, the biasing member 34 is arranged to bias the carriage 38 to the first position. In some embodiments, the biasing member 34 comprises a coil spring. In some embodiments, the biasing member 34 comprises a compression spring. In some embodiments, the biasing member 34 is engaged with the lower stock 26. In some embodiments, the lower stock 26 comprises a seat 37 arranged to engage the biasing member 34. A seat 37 can have any suitable shape arranged to engage a biasing member 34 and in some embodiments, a seat 37 comprises a cavity, a post, etc. In some embodiments, the lower stock 26 comprises a seat member 36 having a first portion shaped to engage the cavity 46 and a second portion comprising a seat 37. In some embodiments, the carriage 34 also comprises a seat 37 arranged to engage the biasing member 34.

FIG. 7 shows the carriage 38 in a second position with respect to the rail 20. In some embodiments, displacement of the carriage 38 loads the biasing member 34. In some embodiments, displacement of the carriage 38 is caused by an application of external force. In some embodiments, the foregrip 30 is attached to the carriage 38, and the foregrip 30 moves with the carriage 38 and vice versa. In some embodiments, external force is applied to the foregrip 30, which causes movement of the foregrip 30 and the attached carriage 38. In some embodiments, the carriage 38 and foregrip 30 will return to their first position when the external force is removed.

In some embodiments, a user may apply a force to the foregrip 30, causing it to displace from its at-rest position. In some embodiments, the user may apply a reacting force of similar magnitude but opposite direction to the rear grip 60. When a user applies counteracting forces such as a force applied to the foregrip 30 and a reacting force applied to the rear grip 60, shooting stability and accuracy may be improved. For example, an amount of "float" present during aiming can be reduced upon the application of counteracting forces.

In some embodiments, the amount of movement of the foregrip 30 in response to an applied force can be adjusted to better suit the user. In some embodiments, different biasing members 34 can be used that provide different movement characteristics. A biasing member 34 with a higher spring constant can move less in response to a predetermined force than a biasing member with a lower spring constant. In some embodiments, multiple biasing members 34 are provided, for example extending between the seat member 36 and the carriage 38.

In some embodiments, the lower stock 26 can comprise an adjustment mechanism to move an at-rest location of the biasing member 16. In some embodiments, the lower stock 26 comprises an adjustable stop member arranged to limit movement of the carriage 38. In some embodiments, an adjustable stop member can comprise a threaded fastener.

Figure 8:
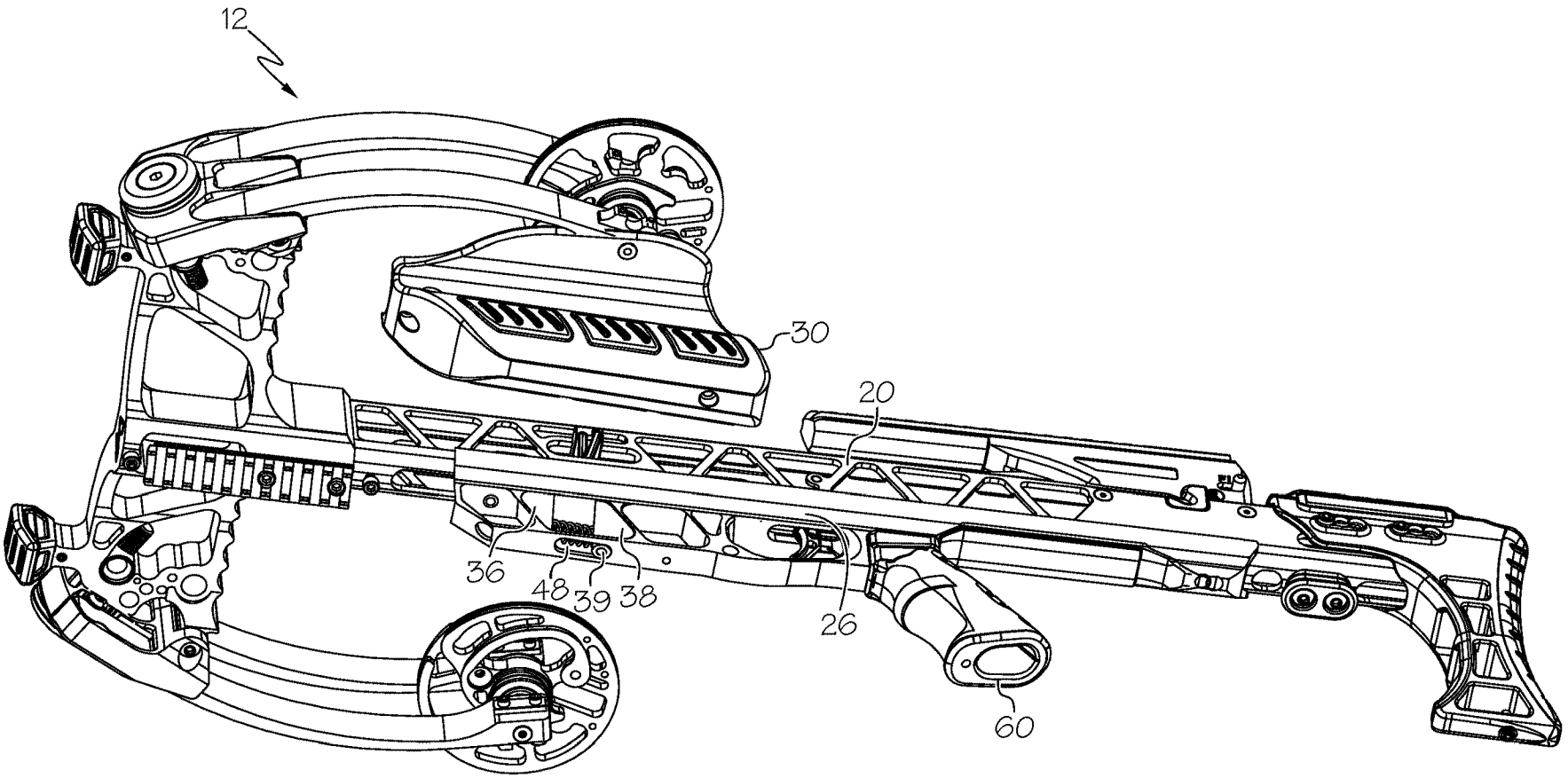
FIG. 8 shows another view of an embodiment of a crossbow.

FIG. 8 shows another view of an embodiment of a crossbow 8.

The above disclosure is intended to be illustrative and not exhaustive. This description will suggest many variations and alternatives to one of ordinary skill in this field of art. All these alternatives and variations are intended to be included within the scope of the claims where the term "comprising" means "including, but not limited to." Those familiar with the art may recognize other equivalents to the specific embodiments described herein which equivalents are also intended to be encompassed by the claims.

Further, the particular features presented in the dependent claims can be combined with each other in other manners within the scope of the invention such that the invention should be recognized as also specifically directed to other embodiments having any other possible combination of the features of the dependent claims. For instance, for purposes of claim publication, any dependent claim which follows should be taken as alternatively written in a multiple dependent form from all prior claims which possess all antecedents referenced in such dependent claim if such multiple dependent format is an accepted format within the jurisdiction (e.g. each claim depending directly from claim 1 should be alternatively taken as depending from all previous claims). In jurisdictions where multiple dependent claim formats are restricted, the following dependent claims should each be also taken as alternatively written in each singly dependent claim format which creates a dependency from a prior antecedent-possessing claim other than the specific claim listed in such dependent claim below.

This completes the description of the preferred and alternate embodiments of the invention. Those skilled in the art may recognize other equivalents to the specific embodiment described herein which equivalents are intended to be encompassed by the claims attached hereto.

The invention claimed is:

1. A crossbow comprising:

a stock defining a shooting axis;

a bow portion attached to the stock;

a latch;

a trigger; and a foregrip supported by the stock and arranged to move with respect to the stock between a first position and a second position, a biasing member arranged to bias the foregrip to the first position, the foregrip comprising a contacting surface and finger guards, the finger guards extending laterally outward from the stock.

2. The crossbow of claim 1, the stock comprising a cavity, the biasing member oriented in the cavity.

3. The crossbow of claim 2, the stock comprising a seat arranged to engage the biasing member.

4. The crossbow of claim 2, comprising a carriage, the foregrip attached to the carriage.

5. The crossbow of claim 4, the carriage oriented in the cavity.

6. The crossbow of claim 4, the carriage engaged with the biasing member.

7. The crossbow of claim 4, the stock comprising a slot, a portion of the carriage oriented in the slot.

8. The crossbow of claim 7, the carriage moving along a length of the slot as the foregrip moves from the first position to the second position.

9. The crossbow of claim 1, the finger guards oriented between the contacting surface and the shooting axis.

10. The crossbow of claim 1, comprising a rear grip.

11. The crossbow of claim 10, the trigger located between the foregrip and the rear grip.

12. The crossbow of claim 1, wherein the foregrip is located closer to the trigger in the first position than in the second position.

13. The crossbow of claim 1, the foregrip moving along a linear path between the first position and the second position.

14. The crossbow of claim 13, the linear path oriented parallel to a shooting axis of the crossbow.

15. A crossbow comprising:

a stock defining a shooting axis;

a bow portion attached to the stock;

a latch;

a trigger; and a foregrip comprising a contacting surface and finger guards, the finger guards extending laterally outward from the stock, the finger guards oriented between the contacting surface and the shooting axis, the foregrip supported by the stock and arranged to move with respect to the stock between a first position and a second position, the first position located closer to the trigger than the second position, the foregrip biased to the first position.

16. The crossbow of claim 15, the foregrip traveling along a linear path between the first position and the second position.

17. The crossbow of claim 16, the linear path oriented parallel to the shooting axis.

18. The crossbow of claim 15, comprising a carriage arranged to move with respect to the stock, the carriage oriented in the stock, the foregrip attached to the carriage.

19. The crossbow of claim 18, the stock comprising a slot, a fastener attached to the carriage and the foregrip oriented in the slot.

* * * * *